United States Patent [19]

Russell

[11] Patent Number: 4,940,444

[45] Date of Patent: Jul. 10, 1990

[54] MINIATURE VEHICLE WITH MAGNETIC ENHANCEMENT OF TRACTION

[76] Inventor: James B. Russell, 5544 Vista Del Dia, Anaheim Hills, Calif. 92807

[21] Appl. No.: 293,622

[22] Filed: Jan. 5, 1989

[51] Int. Cl.[5] ..... A63H 18/00; A63H 33/26; A63G 9/16

[52] U.S. Cl. ..... 446/446; 446/444; 446/136; 446/129; 273/86 B

[58] Field of Search ..... 446/129, 130, 135, 136, 446/138, 444, 445, 446, 447, 465, 466, 467, 469, 470, 484; 273/86 B

[56] References Cited

U.S. PATENT DOCUMENTS

| | | | |
|---|---|---|---|
| 3,350,953 | 11/1967 | Stewart | 446/457 X |
| 3,596,397 | 8/1971 | Colletti | 446/446 |
| 3,813,812 | 6/1974 | Barlow et al. | 273/86 B X |
| 3,964,206 | 6/1976 | Bernhard | 446/455 |
| 4,386,777 | 6/1983 | Prehodka | 446/444 X |
| 4,429,488 | 2/1984 | Wessels | 446/446 |
| 4,479,650 | 10/1984 | Neuhierl | 446/455 X |
| 4,568,300 | 2/1986 | Rasmussen et al. | 446/457 X |

FOREIGN PATENT DOCUMENTS

| | | | |
|---|---|---|---|
| 0200837 | 11/1986 | European Pat. Off. | 446/129 |
| 1074463 | 1/1960 | Fed. Rep. of Germany | 446/129 |
| 3240712 | 5/1984 | Fed. Rep. of Germany | 446/129 |
| 8402084 | 6/1984 | PCT Int'l Appl. | 446/447 |

*Primary Examiner*—Robert A. Hafer
*Assistant Examiner*—D. Neal Muir
*Attorney, Agent, or Firm*—G. Donald Weber, Jr.

[57] ABSTRACT

A miniature electrically powered vehicle including an electric motor having a pair of permanent magnets mounted with the North/South pole axis disposed vertically within the vehicle and with the same polarity ends thereof joined together by a common flux strap so that the magnets serve the dual function of interacting with the electric motor and providing an enhanced downward magnetic attraction of the vehicle to the track.

16 Claims, 2 Drawing Sheets

MINIATURE VEHICLE WITH MAGNETIC ENHANCEMENT OF TRACTION

BACKGROUND

1. Field of the Invention

This invention relates, generally, to miniature electrical vehicles which ride on a track that includes electric power rails and, more particularly, to an improved electric motor arrangement for such a vehicle with an advantageous magnet structure which provides magnetic attraction between the vehicle and the power rails so as to increase the traction of the vehicle against the track.

2. Prior Art

The prior art includes a plurality of electrically powered miniature vehicles usually in the form of automobile race cars, which ride on a track. The track is usually fabricated of a type of plastic and includes at least a pair of power rails embedded in the track. The power rails are electrically conductive, typically of metal such as brass or the like, and are used to provide electrical power to the vehicle.

Miniature vehicles of this general type have been successfully manufactured and marketed in the past. These vehicles include magnets which form the stator of the electrical motor. The electrical power is supplied to the rotor or armature of the motor via a commutator which receives electrical power from the rails via contacts or "shoes" mounted on the vehicle. The armature is typically positioned horizontally between the North/South poles of the magnets.

All other known models employ a motor design wherein the North/South axis orientation of the magnets is horizontal thus limiting the magnetic down force available over the rails. Nevertheless, designers are continuously striving to produce such vehicles capable of quicker acceleration and higher speeds. One problem in the development of such a high speed vehicle is insufficient traction force between the wheels of the vehicle and the track. That is, when an operator applies an electrical signal to produce acceleration or higher speed by the vehicle, the wheels tend to spin needlessly on attempted acceleration and/or the vehicle tends to spin-out on curves. The relatively low traction results largely from the rather insubstantial weight of the miniature electrical vehicles. However, merely increasing the weight of the vehicle does not solve the problem because a vehicle with a larger mass will accelerate more slowly unless a stronger motor is provided, which further increases mass and size.

Typically, in attempting to improve the operation of the car, the weight of the car prevents further improvements. That is, as weight is reduced, traction is reduced. On the other hand, as weight is increased, acceleration and speed are reduced.

Because a substantial portion of the weight of the car is represented by to the relatively bulky magnets required by the relatively large diameter armature, various magnet designs have been explored. These have included the use of the magnets to provide attraction to the power rails, flux adjacent to the magnets, and the like. However, it has not been possible to reduce the size of the motor to any substantial extent in order to reduce its weight, because this would reduce the normal force exerted on the track and would merely re-implement the problems which the arrangement had solved.

What is needed is a substantial, further increase in the normal force of the vehicle against the track so that the weight of the vehicle is reduced without losing traction or so that normal force and traction can be increased without an increase in the mass of the vehicle.

PRIOR ART STATEMENT

The following patents were discovered in a preliminary patentability search.

U.S. Pat. No. 3,243,917—J. E. Giammarino et al. This patent is directed to toy racing cars in which the electric motor includes a flat (pancake-shaped) armature that is coaxially mounted for rotation with a vertical armature shaft coupled to the vehicle wheels through a complicated gear mechanism. The motor also includes as its stator a pair of curved permanent magnets which are mounted in front of and behind the armature, respectively.

U.S. Pat. No. 3,964,206—MINIATURE VEHICLE WITH MAGNETIC FORCE—R. Bernhard. This patent is directed to an electric motor arrangement, in a miniature vehicle, which provides increased traction without increasing the weight of the vehicle. In this arrangement, the permanent magnets of the motor extend downwardly from the vehicle in close proximity to the power rails and exert an attractive force between the rails and the magnets. The attractive force increases the normal force on the car on the track and improves the traction thereof.

U.S. Pat. No. 4,031,661—MINIATURE VEHICLE WITH MAGNETIC ENHANCEMENT OF TRACTION—R. Bernhard. This patent is directed to an electrically operated miniature vehicle for use on a track which has magnetic material embedded in it. More specifically, this device includes a miniature vehicle with a pair of magnets oriented in compartments at opposite sides of the vehicle on either side of the armature. A flux collector associated with each magnet is disposed between the magnet and a side wall of the vehicle and includes a pair of tabs at the upper end which engages the top of a side wall of the vehicle and a flange at its bottom which extends under the magnet. This flange supports the magnet within the vehicle and in close proximity to the power rails, and also enchances the magnetic force applied to the rails.

U.S. Pat. No. 3,531,118—LAP COUNTER FOR VEHICULAR RACING GAME—A. R. Mabie et al. This patent is directed to a sensing means which is responsive to the movement of a magnetic field in proximity thereto so that a counting means and/or a turning means is operated to count or time laps. This system can be used with a coin operated system.

U.S. Pat. No. 3,377,067—MINIATURE RACE COURSE—B. Proietti. This patent is directed to a miniature race course which includes a dielectric board with movable magnets beneath the board. When these movable magnets are actuated, they selectively attract and carry magnetic pieces (vehicles) on the surface of the board in prescribed paths.

U.S. Pat. No. 4,386,777—TOY VEHICLE RACING GAME—B. Prehodka. This patent is directed to an electrically powered toy racing game which permits greater holding force between the vehicles and the track by providing wider electrically conductive rails imbedded in the track whereby the vehicles may move on vertical track portions.

U.S. Pat. No. 4,031,660—ILLUMINATED ACTION TOY—T. Chen. This patent is directed to a toy including a wheel with a magnetized axle which runs back and forth on parallel metal rails while including an illumination means within the wheel and a power source in compartment at the end of the rails.

SUMMARY OF THE INVENTION

This invention relates to an electrically powered toy vehicle of the type frequently referred to as a slot car racer. The arrangement of the vehicle is, for the most part, conventional. However, in the preferred embodiments of this invention, and contrary to the prior art, the magnets are mounted so that the North-South axis is disposed in the vertical direction thus yielding greater down force on the rails of the conventional track. More particularly, the N/S axis of the magnets is substantially normal to the track surface. This arrangement permits the magnets to be used within the motor and to provide an optimum magnetic down force over a broader face of the magnet.

Also, in another embodiment of the invention, the guide pin which is used to maintain the car on the track, is modified to provide a "live axle". That is, the wheels are mounted to the opposite ends of a common axle which is retained in the vehicle by a modified guide pin. This arrangement permits the wheels to be independently and interdependently positioned on the track.

DESCRIPTION OF PREFERRED EMBODIMENTS

Figure 1:
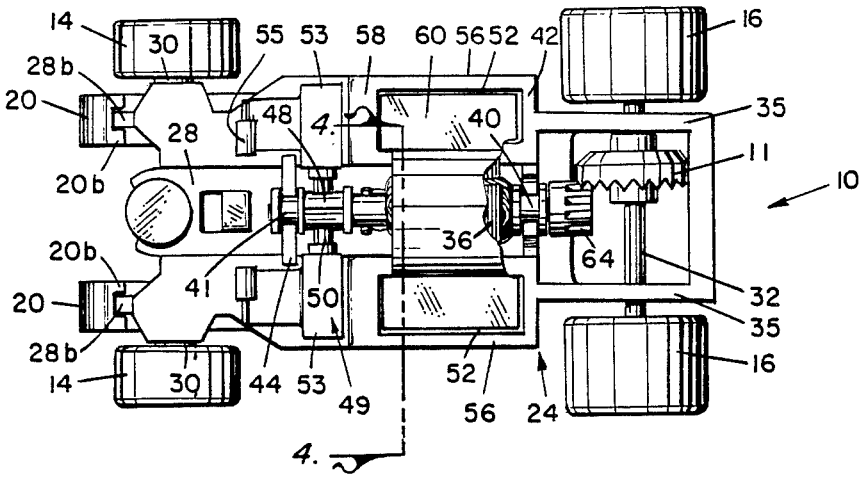
FIG. 1 is a partially broken away, top view of a miniature vehicle from which the vehicle body has been removed in order to clearly show the arrangement of the major components of the vehicle.

Referring generally to the drawings, there is shown a miniature, electrically-powered vehicle designated generally by the reference numeral 10. The vehicle 10 is constructed to ride over the surface of a continuous track 12 (See FIG. 2) on its front wheels 14 and its rear or driving wheels 16. Electric power for the vehicle is provided by a pair of continous, parallel, electrical rails 18 (see FIG. 2) which are embedded in track 12. The rails 18 may, if desired, protrude above track 12. The rails 18 are made of a material which is attracted by a "magnetic" material, typically, but not limited to, steel. A pair of pick-up shoes 20 extend downwardly from the bottom of the vehicle 10. The shoes 20 maintain sliding contact with the rails as the vehicle 10 moves along track 12, thereby delivering electric power to the vehicle. Track 12 also includes a continuous slot 15 therein (see FIG. 4) which is parallel to and between rails 18. The slot 15 is intended to receive a guide pin 22 which extends downwardly from the front of the vehicle 10. Thus, the car 10 is steered through a course around the track as guide pin 22 moves along the slot 15 when the vehicle is propelled by wheels 16.

The vehicle 10 includes a supporting chassis 24 and a body 26, of any desired configuration, which is fitted to the chassis. Chassis 24 is, typically, made of a sturdy plastic material which is lightweight and non-magnetic. The chassis 24 includes a floor 28 and a number of vertical walls or wall components to which the other elements of the vehicle are mounted. In one embodiment, each of front wheels 14 is rotatably mounted on a separate and independent axle 30 which extends outwardly from the floor 28 at the front of the vehicle 10. Guide pin 22 is also mounted at the front of the vehicle between front wheels 14 by conventional means, e.g. a force fit in a slot in the front end of floor 28. Guide pin 22 also extends downwardly below chassis 24 and into the slot 15 in track 12. The rear wheels 16, which may be wider than the front wheels and fabricated of or covered with a suitable material having a high coefficient of friction, are secured to the opposite ends of a common rear axle 32. A crown gear 11 is coaxially secured to axle 32 between the wheels 16. Axle 32 is journaled in parallel side walls 35 of vehicle 10 in suitable fashion.

An electric motor is mounted in the chassis 24 and receives electric power from the power rails 18 through shoes 20 and drives wheels 16 to propel the miniature vehicle 10 around the track 12. The electric motor includes an armature assembly 36 which forms the rotor of the electric motor and is coaxially mounted on drive shaft 38 which is oriented along the length of the vehicle 10. Drive shaft 38 terminates in a coaxially secured pinion 64 which meshes with crown gear 11 to transfer power to rear wheels 16. Drive shaft 38 is journaled in a pair of bearings 40 and 41 which are mounted, respectively, in walls 42 and 44 of chassis 24. Typically, the bearings 40 and 41 are made of brass to present low friction to the rotation of shaft 38.

Figure 2:
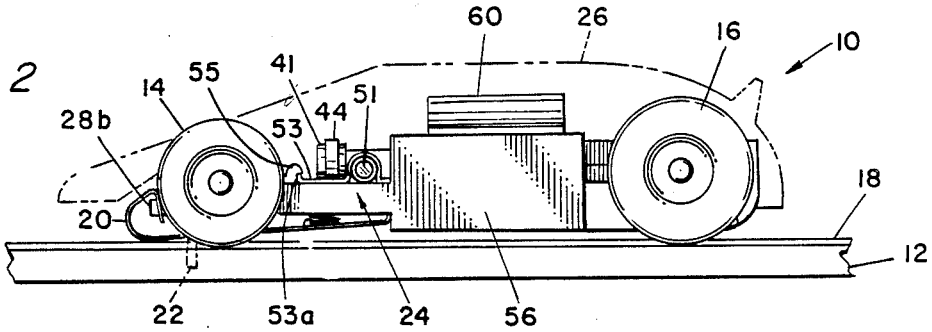
FIG. 2 is a side view, which is partially broken away and partially in section, of the miniature vehicle of FIG. 1.

As seen best in FIGS. 1 and 2, each of bearings 40 and 41 includes a pair of rectangular flanges at its ends which restrain the bearing against axial movement. The bearings 40 and 41 are retained in vertical guideways or slots cut in walls 42 and 44, respectively. The guideways are slightly narrower than the outside diameter of the respective bearing, but include a detent at the end of the guideways so that the bearings may be pressed down into the guideways and be retained in position therein.

Figure 3:
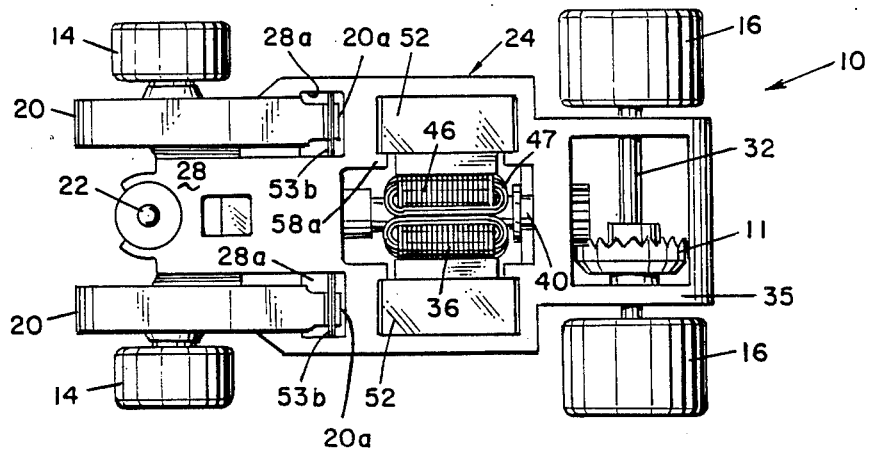
FIG. 3 is a bottom view of the miniature vehicle of FIG. 1 showing further details of construction.
Figure 4:
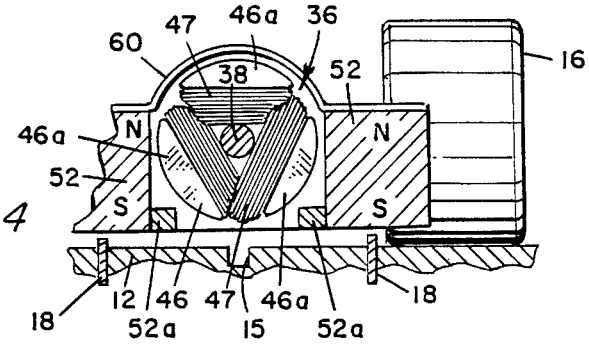
FIG. 4 is an enlarged, partial sectional view, taken along the line 4—4 in FIG. 1, showing the arrangement of the motor armature, permanent magnets and flux bridge in the vehicle.

The armature assembly 36 includes a generally cylindrical core 46 which is, typically, comprised of a plurality of disk-like soft iron laminations (as seen best in FIG. 3). As best seen in FIG. 4, the core 46 is partly cut away or slotted to form three core segments **46*a*. A separate winding 47 of insulated wire is wound on each of the core segments 46*a* in the conventional fashion for miniature electric motors. A segmented commutator 48 is coaxially mounted on shaft 38 between bearing 41 and armature 36. The commutator 48 serves as an electrical contact for supplying electrical power to the windings 47. Thus, electrical power is provided from rails 18 to commutator 48 by means of contact shoes 20 and a pair of brush assemblies 49 which include brushes 50**.

The brush assemblies 49 are mounted on floor 28 on either side of commutator 48 and the brush assemblies 49 are retained by means of spring clips 53. Spring clips 53 each have a first end 53*a* retained by a lug 55 protruding upwardly from chassis floor 28. As seen best in FIG. 3, a second end 53*b* of each clip 53 extends down through a hole 28*a* in floor 28 and is detachably coupled to a first end 20*a* of one of shoes 20. Each of shoes 20 extends towards the front of the vehicle and curves upward over a projection 28*b* of floor 28 as seen in FIGS. 1 and 2.

As best seen in FIG. 1, the end 20*b* of each shoe 20 is bifurcated and curves downward and over projection 28*b* so that the bifurcation straddles the projection. A spring 51 disposed between the bottom of floor 28 and the top surface of contact shoe 20 keeps the shoe biased for continuous engagement with rail 18 whereby vehicle 10 is continually provided with electric power.

The stationary or stator component of the electric motor comprises a pair of magnets 52 each mounted in a compartment of chassis 24 on either side of armature 36. The compartments are substantially open at the bottom and at the side adjacent to the armature. This permits the magnets to extend through the floor of chassis 24 and to be in close proximity to rails 18 thereby providing an attractive force holding vehicle 10 to track 12. Each of the magnet compartments is formed by a portion of wall 42, a side wall 56 opposite the armature, a wall 58, and projections which extend normal to walls 42 and 58, respectively. This construction of the vehicle is substantially convention.

The magnets 52 are identical in configuration and assembly. (As best seen in FIGS. 1 and 3, each of the magnets 52 conforms to the shape of the compartment 54 in chassis 24.) That is, both magnets 52 have the South pole on the bottom and the North pole at the top or (vice versa). That is, both magnets have the North-/South axis vertically aligned (rather than horizontally as in the prior art). While the magnets are generally rectilinear, each magnet 52 may have the inner surface thereof curved to conform to armature 36 in a preferred embodiment.

Figure 4A:
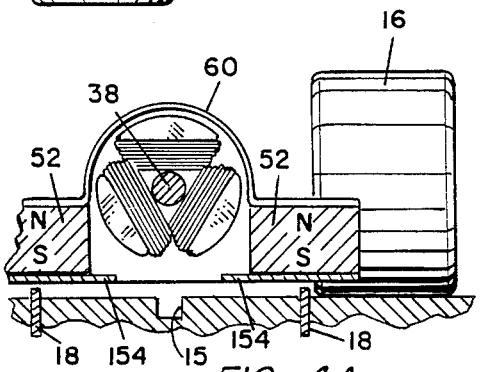
FIG. 4A is a modification of the embodiment shown in FIG. 4.

Flux bridge 60, preferrably made of ferrous sheet material, is mounted to interconnect the magnets 52. In particular, flux bridge 60 has the ends thereof joined to the upper surface (for example the North pole) of each of the magnets 52. The center portion of the flux bridge is curved so that it overpasses the motor, in particular the armature portion, of the vehicle. Of course, if the motor is made smaller or lower, the flux bridge 60 can be made flat without the curved portion, per se. The flux bridge 60 has the effect of joining the magnets 52 to provide a more complete flux path for the motor. In some versions, as best seen in FIGS. 4 and 4A, a pair of pole pieces 52*a* extend outwardly from the bottom of the magnets 52 toward the motor. It has been found that pole pieces 52*a* can provide a considerable increase in the magnetic flux applied to the motor 10 by the magnets 52. The particular configuration for the pole pieces 52*a* shown in FIGS. 4 is adequate to provide magnetic flux to the motor and, as well provide the broad magnetic flux surface from magnets 52 to the rail 18 and, yet, permit utilization of a smaller magnet. That is, because the flux bridge 60 covers and contacts most (if not all) of the top surfaces of magnets 52 and is made of a ferrous material, it represents a relatively low reluctance path for magnetic flux or field lines. Thus, those magnetic flux lines which normally emanate from the top or back of magnet 52 and disperse into the space surrounding the vehicle 10 are concentrated in flux bridge 60 and are directed downwardly, in parallel, so as to emanate from the bottom of magnets 52.

As can be seen in FIG. 4, the bottom surfaces (for example, South poles) of magnets 52 are generally disposed above the rails 18, whereby the concentrated field lines which emanate from each magnet 52 are directed to the respective rail 18. This arrangement results in a stronger magnetic attraction than is provided by the horizontally mounted magnets of the prior art even when used with flux collector devices.

It has also been found that with the flux bridge 60 the magnetic field applied to armature 36 is strengthened. It is believed that this results from the decrease in reluctance between the magnets 52 because of the complete flux path provided by bridge 60. Owing to this decrease in reluctance, field lines which would normally pass through the air space between the tops of the respective magnets find a lower reluctance path therebetween and the armature 36 and, thus, pass between the armature and the magnet. The resulting increased strength in the magnetic field directed to the armature increases the torque and power of the motor.

The motor arrangement described above, with the magnets 52 mounted at the sides of chassis 24, with the vertical North/South pole configuration, is particularly efficient in providing an attractive force between the vehicle 10 and the power rails 18. This is due in part to the fact that the magnets 52 extend along the power rails 18 and are able to provide magnetic attraction along the entire length and width thereof.

Referring to FIG. 4A, there is shown another version of the car using the instant invention. That is, the side mounted magnets 52 have the North/South axis arranged vertically. However, in this embodiment a much lower profile magnet is used. This can be the result of the use of materials with improved magnetic properties, for example. All other known models employ a motor design wherein the North/South axis orientation of the magnets is horizontal thus limiting the magnetic down force available over the rails.

Also, additional pole pieces 154 can be provided at the lower surfaces of the magnets 52. These pole pieces, which function akin to the flux collectors of the prior art, are used primarily to redirect the magnetic flux lines from the magnets 152 toward the armature 36. However, the advantages described above relative to the instant invention are realized, as well.

Figure 5:
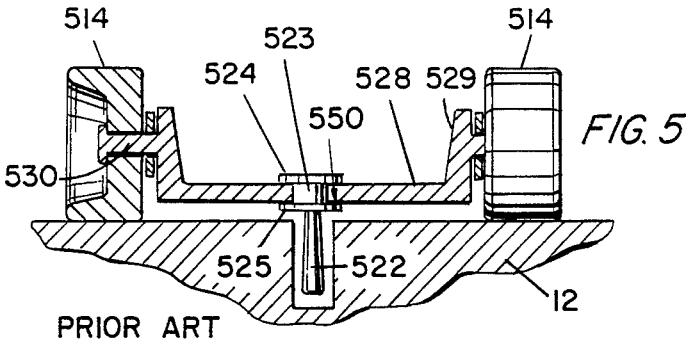
FIG. 5 is a schematic, cross sectional view of the front axle suspension of the prior art devices.

Referring now to FIG. 5, there is shown a schematic representation (partially in section) of the front end suspension of miniature electrical vehicles which are known in the art. In this embodiment, the front wheels 514 are the type which are conventional in the art. The wheels 514 are fixed to the chassis 528 of the vehicle by means of suitable mounting means 529. The separate and independent axle 530 for each wheel 514 is mounted in the mounting 529.

A guide pin 550 is also mounted in the chassis 528. In particular, the chassis 528 includes a groove or snap-in portion in the front thereof. This groove receives the center core 523 of the guide pin 550 which is disposed between the two horizontal plates 524 and 525 of the guide pin 550. The dimensions of the snap-in groove and the guide pin components are arranged so that a tight fit is effected so that the depending guide pin 522 can be used to guide the vehicle around the track by depending into slot 515 in the track 12. If necessary, the guide pin mechanism can be adhered to the chassis by means of glue or other suitable adhesive. In the prior art, the wheels 514 are mounted to fixed axles and a rigid suspension system is provided. This system permits the vehicles to "jump" off the track with any bumps or warped portions of the track.

Figure 6:
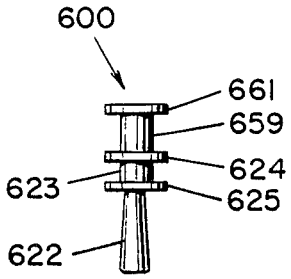
FIG. 6 is a plan view of the guide pin used in the improved front end suspension apparatus of the instant invention.

Referring now to FIG. 6, there shown a new and improved guide pin 600 which is useful for providing another embodiment of the instant invention. In particular, the new guide pin permits a "live axle" apparatus as described hereinafter.

The guide pin 600 includes the plates 624 and 625 as well as the guideplate 661. The barrel or core 623 is disposed between the plates 624 and 625. In this regard, the guide pin 600 is similar to the prior art device. However, in the guide pin 600 an additional barrel 659 is provided between the plates 624 and 651. The barrels 623 and 659 are of substantially the same diameter. However, in a preferred embodiment, the barrel 659 is taller than the barrel 623. The depending guide pin 622 extends below the lower plate of the guide pin as in the case of the prior art.

In essence, the guide pin 600 below plate 624, i.e. from the plate 624 to the bottom of guide 622 is substantially identical to the guide pin 522 shown in FIG. 5.

In addition, the barrel 623 will mate with the groove or slot in the base of the racing car apparatus which is identical to that of the prior art. However, the barrel 659 and plate 661 extend above the chassis 528 of the vehicle, as described hereinafter.

Figure 7:
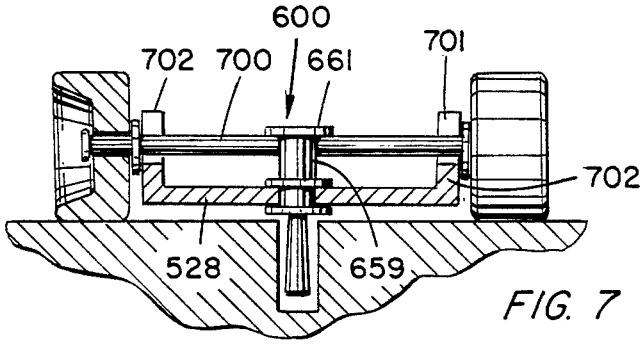
FIGS. 7 and 8 are schematic representations of the front end suspension of the apparatus in the instant invention in different operation position.
Figure 8:
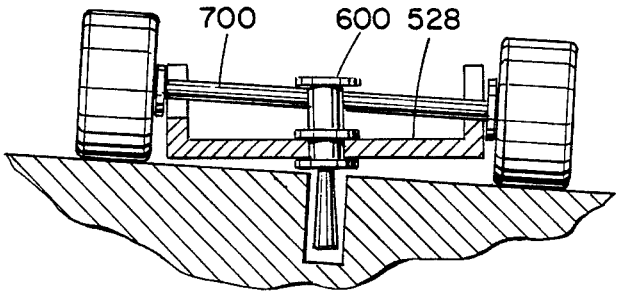

As shown in FIGS. 7 and 8, improved guide pin 600 is mounted into the chassis 528 in the same fashion as in the prior art. However, as noted, the barrel 659 extends above the chassis.

In this instance, the vehicle axle, 700, referred to as a "live axle" is disposed in vertical slots 701 which are formed in vertical walls 702 on opposite sides of the chassis 528. In the preferred embodiment, the slots 701 are closed at the bottom but open at the top. These slots have a vertical length substantially equal to the height of the side wall 702. When the axle 700 is placed within these slots, the axle is free to move, vertically, at either end thereof.

In addition, the axle 700 is disposed under the plate 661 of guide pin 600 and behind the barrel 659 of pin 600. The slots 701 are disposed in the wall 702 in an arrangement relative to the guide pin 600 so that the axle 700 is maintained within the slots 701 and below plate 661. However, the axle 700 is free to move vertically between the plates 651 and 624. Moreover, axle 700 is free to move vertically at either end. The relationship between barrel 659, plates 623 and 661 and the vertical length of slots 701 is such that the axle does not become disengaged from side wall 702.

As shown in FIG. 8, the "live axle" 700 is permitted to freely move at either end (or both ends if need be). This will permit the vehicle to operate on a track which has become warped, for example. The rear wheels of the vehicle are generally not arranged to have such a live axle in order to maintain full contact with the track.

Figure 9:
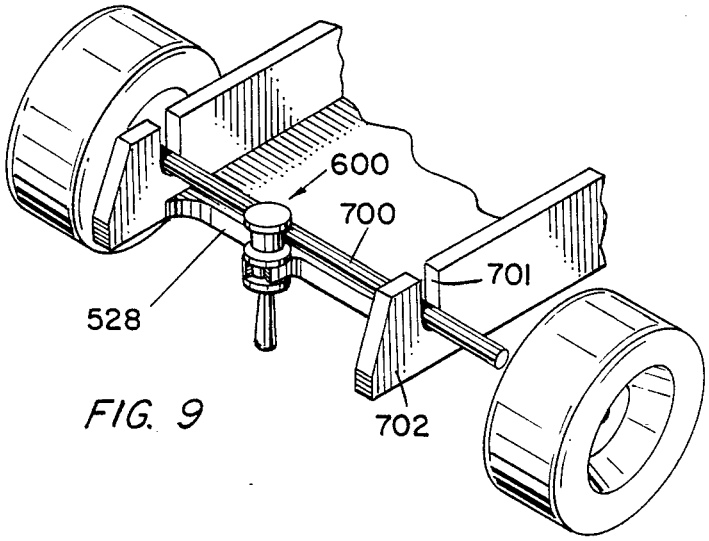
FIG. 9 is a partial perspective view of the front end suspension of the apparatus of the instant invention.

Referring now to FIG. 9 there is shown a schematic representation of the arrangement of the guide pin 600 relative to the chassis 528, as well as the side walls 702. Since the bottom portion of pin 600 is mounted substantially perpendicular to chassis 528 and included in the slot or groove in the front thereof, the axle 700 is retained by plate 661 of pin 600 but is free to move, vertically, within slot 701. This arrangement permits a free, live action suspension.

Although a specific embodiment of the invention has been shown for illustrative purposes, it will be appreciated by those skilled in the art that many modifications, additions and/or substitutions are possible without departing from the scope and spirit of the invention. Any such modifications are intended to be included in this description. The description is illustrative only and is not intended to be limitative. Rather, the scope of the invention is limited only by the claims appended hereto.

I claim:

1. A miniature vehicle adapted to operate on a track including as a part thereof electric power conductor means made of a magnetic material comprising;

a support chassis;

a drive wheel mounted to said chassis;

an electrical pick-up shoe engageable with said power conductor means;

an electric motor mounted on said chassis;

said electric motor including a rotatably mounted drive shaft coupled to said drive wheel;

an armature means mounted on said drive shaft;

means for coupling said armature means to said pick-up shoe for providing electrical power to said electric motor;

a pair of magnets mounted to said chassis on opposite sides of said armature means and forming a stationary magnetic component of said electric motor;

each of said magnets mounted so that the North-/South axis thereof is vertically disposed relative to said track with the same polarity of said pair of magnets at a upper surface thereof; and flux bridge means connected to the upper surface of each of said magnets and overlying said armature means thereby to direct magnetic flux from said pair of magnets in a single direction whereby said pair of magnets and said flux bridge means cooperate to provide an enhanced magnetic force at said electric power conductor means to thereby attract said vehicle toward said track and increase the traction of said drive wheel on said track.

2. The vehicle recited in claim 1 wherein, said flux bridge includes an arcuate portion which overlies said armature means.

3. The vehicle recited in claim 1 wherein, said means for coupling comprises commutator means.

4. The vehicle recited in claim 1 wherein, said armature includes a core of magnetizable material and a plurality of windings thereon.

5. The vehicle recited in claim 1 wherein, each of said magnets is conformed such that the lower surface thereof is disposed nearer to said armature means than said upper surface.

6. The vehicle recited in claim 1 wherein, said flux bridge means is formed of a magnetizable material.

7. The vehicle recited in claim 1 wherein, said magnets include a flux plate at the lower surface thereof.

8. The vehicle recited in claim 1 wherein, said magnets are reclilinear in configuration.

9. The vehicle recited in claim 1 including, a pair of compartments formed at the opposite sides of said supporting chassis for respectively mounting said pair of magnets therein.

10. The vehicle recited in claim 9 wherein, each of said compartments is substantially open at the bottom thereof whereby the respective magnet is exposed to said electric power conductor means of said track.

11. The vehicle recited in claim 7 wherein, said flux plate extends toward said armature means.

12. The vehicle recited in claim 5 wherein, said magnets each includes a curved surface adjacent to said armature means.

13. The vehicle recited in claim 1 including, front wheel means mounted at the front of said chassis, said drive wheel is mounted at the rear of said chassis.

14. A toy vehicle including, front and rear wheels attached thereto so that said vehicle can move on said wheels;

said front wheels mounted on a common axle;

a chassis of said vehicle including side walls and a bottom wall;

said common axle mounted loosely in apertures in said side walls;

a guide pin rigidly mounted in said bottom wall;

a first portion of said guide pin extends below said bottom wall for selective interaction with a direction controlling component; and a second portion of said guide pin extends above said bottom wall for loosely engaging and retaining said common axle between said side walls whereby said common axle is capable of moving within said apertures in said side walls, said second portion of said guide pin includes an enlarged end which constrains said common axle from becoming separated from said chassis.

15. The vehicle recited in claim 14 wherein, said chassis includes a slot which receives said first portion of said guide pin in a friction fit.

16. A driving mechanism for a miniature vehicle including, an electric motor, said electric motor including a rotatably mounted drive shaft, armature means mounted on said shaft, commutator means for coupling said armature means to an electrical power source, first and second magnets each having a north pole and a south pole, said first and second magnets mounted on opposite sides of said armature means and forming a stationary magnetic component of said electric motor, each of said first and second magnets mounted so that the North/South axis thereof is parallel to the North/South axis of the other magnet and substantially tangential to said armature means, and flux bridge means connected to an upper pole face of each of said first and second magnets and overlying said armature means thereby to direct magnetic flux from said first and second magnets in the same direction whereby said first and second magnets and said flux bridge means cooperate to provide an enhanced magnetic force with respect to electrical power rails beneath said vehicle to thereby attract said vehicle thereto, said flux bridge has the respective ends thereof connected to like polarity, faces of each said first and second magnets.

* * * * *